United States Patent [19]

Grooms

[11] Patent Number: 4,647,249

[45] Date of Patent: Mar. 3, 1987

[54] ACCRETION APPARATUS FOR USE IN TIDAL ENVIRONS AND METHOD

[76] Inventor: Joseph J. Grooms, Rte. 1, Box 469, Ridgeville, S.C. 29472

[21] Appl. No.: 676,480

[22] Filed: Nov. 29, 1984

[51] Int. Cl.[4] ..... E02B 3/06

[52] U.S. Cl. ..... 405/28; 405/21; 405/25; 425/385

[58] Field of Search ..... 405/15, 17, 18, 21–35, 405/73; 404/6; 425/62–64, 385

[56] References Cited

U.S. PATENT DOCUMENTS

| | | | |
|---|---|---|---|
| 2,655,790 | 10/1953 | Daley | 405/28 |
| 3,214,916 | 11/1965 | Martin | 405/28 |
| 3,830,066 | 8/1974 | Larsen | 405/25 |
| 4,362,424 | 12/1982 | Barber | 404/6 |
| 4,367,977 | 1/1983 | Schaaf et al. | 405/25 |
| 4,439,058 | 3/1984 | LeMehaute | 405/28 X |

FOREIGN PATENT DOCUMENTS

| | | | |
|---|---|---|---|
| 694357 | 9/1964 | Canada | 405/22 |
| 586228 | 12/1977 | U.S.S.R. | 405/21 |

OTHER PUBLICATIONS

"Beach Prisms–A Shore Erosion Protection System Embodying an Artificial Beach Stabilizer", Peter R. Payne, Ocean Engng., vol. 7, pp. 327–345, 1980.

*Primary Examiner*—Richard J. Scanlan, Jr.
*Assistant Examiner*—Nancy J. Stodola
*Attorney, Agent, or Firm*—Dority & Manning

[57] ABSTRACT

Apparatus for placement in front of tidal wave action to cause settlement of sand from the water and thus land accretion. The apparatus includes a base section having a flexible barrier section secured thereto and extending upwardly therefrom. Method and apparatus for installing and removing the accretion apparatus are also disclosed and claimed.

15 Claims, 9 Drawing Figures

ACCRETION APPARATUS FOR USE IN TIDAL ENVIRONS AND METHOD

BACKGROUND OF THE INVENTION

The present invention relates to a system for buildup of shoreline around tidal waters, and means for implementing the use of same.

A problem continually exists along the shoreline of tidal waters due to the wave action that causes erosion of same, depending upon the direction of currents and the location of barrier elements with respect to the particular shoreline segments. Obviously, erosion of the shoreline, particularly around beach areas can create problems that are not only aesthetic in nature, but which can cause structural problems by undermining sea walls, building structures and the like. It has been, and is now, therefore, very desirable to be able to implement accretion along shorelines by causing sand suspended in the water to deposit from the waves. Such not only affords ultimate protection for the shoreline, but also additionally after buildup, offers greater resistance to the incoming waves and thus impedes water reaching certain elements at times of high tide. Likewise, such buildups can prevent further erosion of the land.

Many and various techniques have theretofore been employed in conjunction with tidal waters, particularly along the coastline to attempt to cause sand carried by the water to settle therefrom during wave movement, and thus achieve accretion.

To date, such efforts have not met with any significant success. In fact, in areas along the shoreline where erosion of the beach presents a problem, efforts to thwart the erosive action have included the construction of jetties or groins that extend outwardly into the water in an attempt to break the wave action, and to reduce the vector current forces that wash out the beach. Further, seawalls are continually being erected in an attempt to hold back the force of the waves and the water per se with respect to areas where otherwise, at high tide, washing or erosion action could occur. Such present attempts are wholly indicative of the unsatisfactory prior art attempts to develop systems for placement in affected areas to bring about accretion as mentioned above.

The system of the present invention overcomes the problems of the prior art and is adapted for ready placement and removal along the shoreline to achieve a general buildup of the beach area without the tremendous expenses and undertakings of the prior and other present attempts.

While certain of the prior art structures are similar to the system of the present invention, there is no prior art that is believed to anticipate or suggest the system of the present invention. Particularly, exemplary prior art that is deemed to be at least of interest value relative to the present invention includes U.S. Pat. Nos. 226,772; 278,975; 1,969,123; 2,185,458; 2,639,587; 2,655,790; and 3,214,916. Each of the above patented systems in some way attempts to cause the sand suspended in the water to settle out on a continual basis whereby gradual buildup of land will occur. Each of the systems, however, is fraught with problems, particularly in the area of movement of the system once a particular amount of accretion has occurred, all of which are overcome by the present invention.

SUMMARY OF THE INVENTION

It is an important object of the present invention to provide an improved system for the accretion of shoreline in tidal areas.

Another object of the present invention is to provide an improved system for the removal of suspended sand from water along the coastline, resulting in a buildup of the beach in areas in which the system is utilized.

Still another object of the present invention is to provide an apparatus for buildup of land mass along shorelines which apparatus can be reinstalled at a higher elevation or different segment of shoreline as desired.

Still further another object of the present invention is to provide an improved apparatus that may be utilized for accretion of land along an extended portion of shoreline.

Yet another object of the present invention is to provide a system for land accretion which may be automatically installed and removed.

Still further another object of the present invention is to provide a novel apparatus for handling land accretion apparatus.

Another object of the present invention is to provide a method for installing and/or removing accretion apparatus.

Generally speaking, the land accretion apparatus according to the present invention comprises a base support, said base support having a flexible vertical barrier secured thereto and extending upwardly therefrom, the height and flexibility of said barrier being such that incoming wave forces will cause deflection of the barrier whereby water will pass thereover, after which said barrier will return to a generally vertical orientation and retain the water therebehind for a period of time adequate for sand to settle therefrom and after adequate water buildup therebehind, the barrier will deflect in the direction of oncoming waves to release water from which sand has settled.

More specifically, the land accretion apparatus of the present invention includes a barrier section as defined above with a base support at a lower end of same that extends outwardly therefrom in opposite directions, such that the apparatus may be simply laid on a land surface to be built up with the barrier section perpendicular to oncoming waves. Sand will thus settle from the water on a side of the barrier section opposite the body of water, and once a predetermined amount of land has built up thereat, the apparatus may be removed and relaid for continuing vertical buildup of the area.

While the apparatus may be manufactured from discrete elements that are secured in a set form, in a preferred embodiment, the apparatus comprises a generally planar element in which a barrier section is located intermediate the width of same with base sections secured to opposite sides of the barrier section. The base sections may then be moved inwardly, portions of the barrier section moved upwardly to define the vertical barrier. Such an embodiment further preferably includes means located along the underside of opposite barrier portions for interengagement when the barrier portions assume a vertical disposition to secure the barrier section thereat. With such an arrangement, the apparatus may be automatically played out onto the land surface from a prime mover and may be lifted from the land surface by the prime mover. The barrier section is erected during playout of material and flattened during takeup of material whereby the planar element may be stored in roll form.

Insofar as the method of installation is concerned, the general steps of same include providing a supply of accretion apparatus, said apparatus comprising a base section and a barrier section secured to said base section and being adapted to extend transversely outwardly therefrom for generally vertical disposition when installed; mounting said supply of material on a prime mover; dispensing said material generally along a body of water onto a land surface to be built up as said prime mover traverses said land surface, said material being deposited on said land surface with said base section in contact with said surface and said barrier section extending upwardly therefrom, whereby waves from said body of water will encounter said barrier, and upon application of adequate force will deflect said barrier in a direction away from said water thus permitting water to pass thereover, after which said barrier section will return to a generally vertical disposition and hold water therebehind to permit sand to settle therefrom to build up the land surface.

With the accretion apparatus being provided as a generally planar element, and having a barrier section comprised of barrier portions located intermediate the width of the element with base sections secured to outer edges of the barrier portions, the apparatus may be utilized in roll form mounted on the front of a prime mover such as a jeep or the like. A forming or guide unit may be likewise located on the prime mover immediately adjacent the roll of material such that when the material is fed therethrough during playout of the accretion apparatus, the generally flat, planar material will be formed into the accretion apparatus. Particularly, as the material passes through the forming guide, barrier portions of the material will be forced upwardly and the base sections inwardly, thus forming the barrier section of the apparatus. The connector means then interengages and the apparatus is deposited onto the surface in its operative form. Conversely, during retrieval of the apparatus, as the apparatus is lifted and passed through the forming unit, the barrier portions are separated and the apparatus is returned to its flat condition for formation of the roll.

DESCRIPTION OF THE FIGURES

The construction designed to carry out the invention will be hereinafter described, together with other features thereof.

The invention will be more readily understood from a reading of the following specification and by reference to the accompanying drawings forming a part thereof, wherein an exmaple of the invention is shown and wherein.

DESCRIPTION OF A PREFERRED EMBODIMENT

Making reference to the figures, preferred embodiments of the present invention will now be described in detail.

Figure 1:
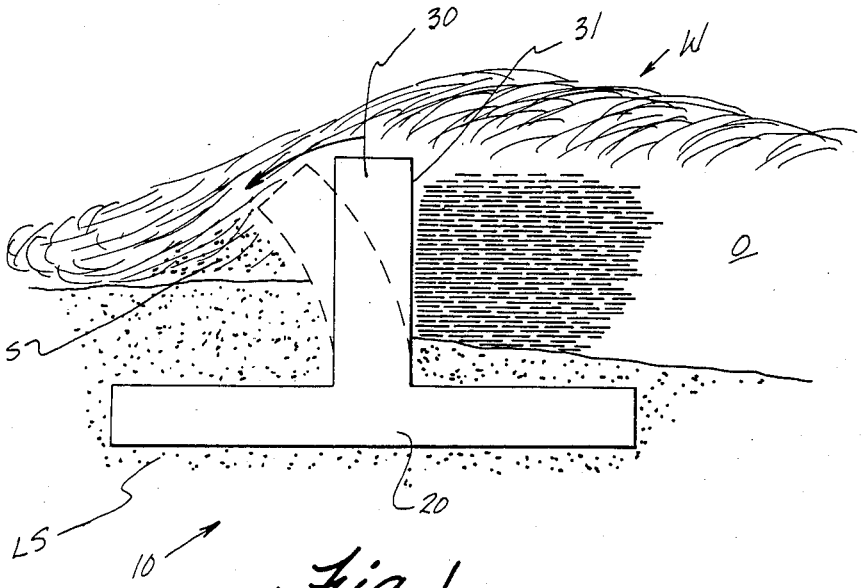
FIG. 1 is a side elevational view of accretion apparatus according to teachings of the present invention illustrating the buildup action that occurs.
Figure 2:
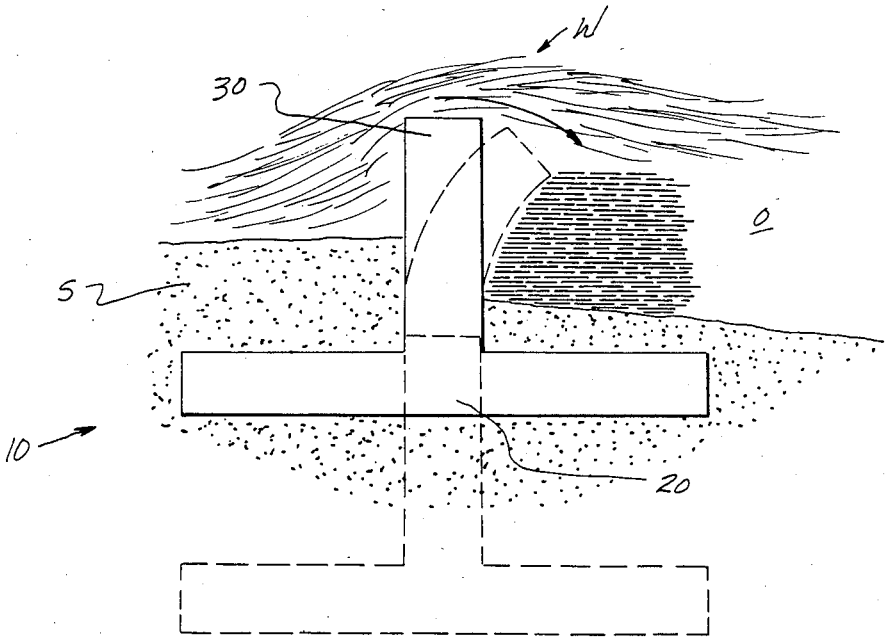
FIG. 2 is a side elevational view of an accretion apparatus according to the present invention in which a prior buildup and deployment of the apparatus is illustrated in phantom and in which the apparatus is illustrated in solid line at a higher location for further buildup.

FIGS. 1 and 2 illustrate an accretion apparatus according to the present invention in a most basic form generally indicated as 10 and deployed to cause land buildup or accretion. Particularly, the accretion apparatus generally indicated as 10, includes a base section 20 have a barrier section 30 secured thereto and extending upwardly therefrom. As illustrated, the accretion apparatus 10 is of unitary construction, though as pointed hereinafter other embodiments are illustrated and described. Accretion apparatus 10 is deployed with base section 20 flat against the land surface LS above which buildup is desired, and with the barrier section 30 extending generally vertically upwardly therefrom, perpendicular to the direction of movement of waves W emanating from an ocean O. In FIG. 1 the barrier section 30 is shown deflected (in phantom) away from the ocean O with the deflection having been brought about by the force of waves W. After deflection, waves W will pass thereover and the barrier section 30 will return to the generally vertical disposition as shown in solid lines, permitting water to be held therebehind. As such, sand S suspended in the water will settle out along an area about the base 20 behind barrier section 30 to achieve accretion of the land surface thereat.

Referring now to FIG. 2, it can be seen that once a general buildup has occurred, accretion apparatus 10 may be lifted from the buildup surface and placed thereabove to permit yet further buildup. Further, as shown in FIG. 2, the barrier section 30 is deflected forwardly in the direction of ocean O (in phantom). Such occurs when water collected behind barrier 30 imparts adequate force on barrier 30 to cause deflection of same in the opposite direction as that shown in phantom in FIG. 1. Water adjacent an upper end of barrier 30 will then flow back to ocean O.

As waves continually move against a forward surface 31 of barrier section 30, once the force of waves W is adequate, barrier 30 will deflect rearwardly as shown in phantom in FIG. 1 in the direction of the arrow permitting the water to pass thereover. A release of the wave force will then permit barrier 30 to return to a generally vertical disposition trapping the water therebehind for an adequate period of time to permit sand suspended in the water to settle therefrom and collect behind barrier 30. Thereafter, as is particularly illustrated in phantom in FIG. 2, once the amount of water behind barrier 30 becomes great enough, the force of the weight of the water will cause the barrier 30 to deflect forwardly in the direction of the ocean and thereby permit some of the collected water to escape therefrom. When such occurs, however, the returning water escapes only above barrier 30, whereby, the sand suspended behind barrier 30 is generally not effected, particularly since the water returning is in a less turbulent condition. Such action will thus continue until sand buildup behind barrier 30 becomes great enough that further buildup will not occur. At such point, it is necessary to lift the accretion apparatus 10 from its then position, to shake the sand therefrom, if necessary, and to replace apparatus 10 atop the then upper surface of the land which would include the sand previously built up from the action described above.

Figure 3:
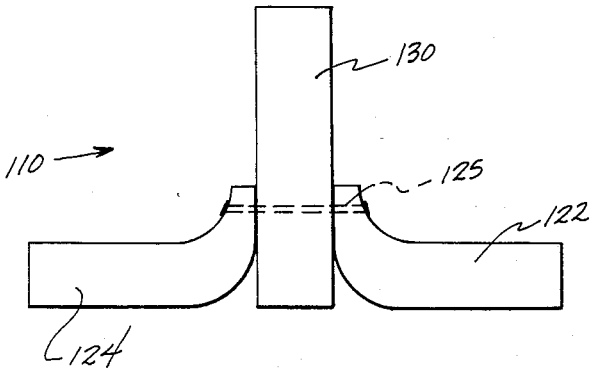
FIG. 3 is a side elevational view of a further embodiment of accretion apparatus of the present invention.

Referring to FIG. 3, a further embodiment of the accretion apparatus 110 of the present invention is shown wherein the base section is comprised of a first base section 122 and a second base section 124, both of which are secured to opposite sides of the barrier 130 by bolts, rivets or the like 125. Such embodiment may be very conveniently produced from scrap rubber belting or the like, providing a very economical accretion apparatus, the length of same being limited only by the materials employed and the means by which the apparatus is moved about as will be described in more detail hereinafter.

Figure 4:
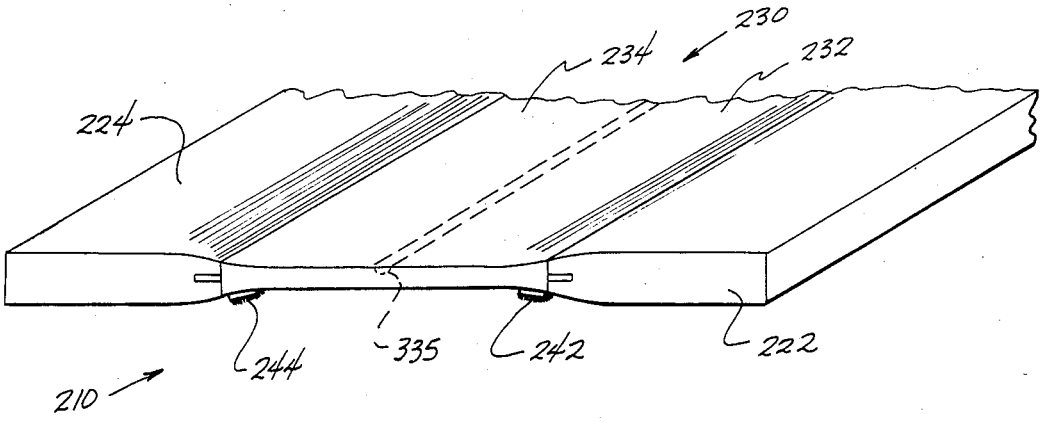
FIG. 4 is an isometric view of a section of accretion apparatus of yet a further embodiment of the present invention.
Figure 5:
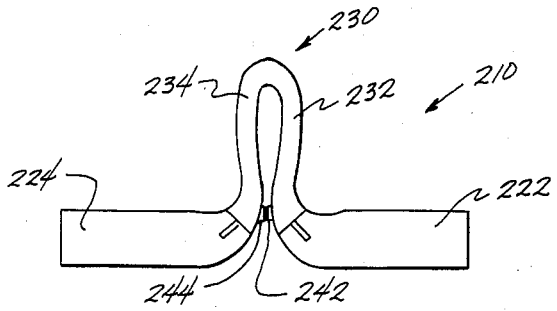
FIG. 5 is an end elevational view of the embodiment as shown in FIG. 4 in an erected, operative state.

FIG. 4 represents yet a further embodiment of an accretion apparatus 210 according to teachings of the present invention where, prior to installation and after removal, apparatus 210 assumes a generally flat or planar condition. Particularly, base sections 222 and 224 are secured to opposite sides of a barrier section generally 230, the thickness of which is generally less than that of base sections 222 and 224. When base sections 222 and 224 are moved inwardly, or barrier portions moved upwardly, barrier section 230 will be formed with portions 232 and 234 on opposite sides of same. As particularly shown in FIG. 4, securement means 242 and 244 are located on an underside of barrier portions 232 and 234, respectively, such that when the barrier 230 is erected, the securement means will become interengaged to hold the apparatus in the erected condition as is illustrated in FIG. 5. Securement means 242, 244 may be an array of hooks and an array of a hook receiving Velcro type products, or may be any other acceptable connector element to that may become removably interengaged upon receipt of pressure. With this particular embodiment of the present invention as will be described in more detail hereinafter, the initial flattened condition of the apparatus permits ease of installation and removal of same by a prime mover such that an indefinite length of the apparatus may be utilized along a beach area. Furthermore, while the flattened apparatus and the erected apparatus of FIGS. 4 and 5 are depicted with the barrier section generally 230 shown to be separate from and secured to the base sections 222 and 224, obviously the embodiment could be produced in unitary fashion as similarly illustrated in FIGS. 1 and 2 such that a continuous width of material is extruded or otherwise formed with the particular relative thicknesses as generally illustrated in FIGS. 4 and 5.

Figure 6:
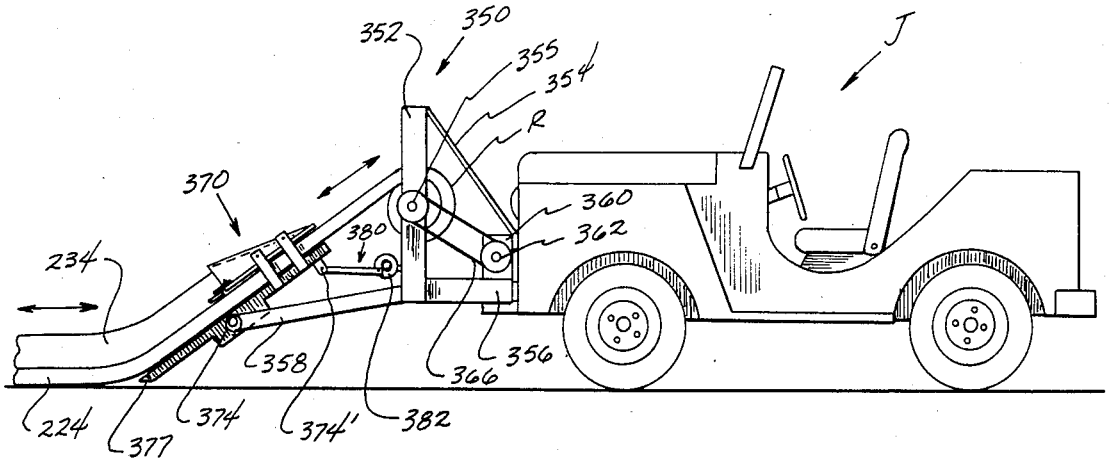
FIG. 6 is a side elevational view of apparatus for installation or removal of the accretion apparatus from a land surface to be built up.

Making reference to FIG. 6, a suitable means for installation and removal of the accretion apparatus according to the present invention is illustrated wherein a prime mover such as a jeep generally indicated as J is provided having a mounting frame generally 350 secured to a front end of the vehicle. Frame 350 includes a first vertical strut 352 that is secured to a front end of jeep J by further struts 354 and 356. Additionally, although not illustrated, other structural elements could be provided to ensure stability of framework 350. A roll R of accretion apparatus 210 is shown supported by framework 350 about an axle 355 that extends through vertical support strut 352. Obviously a like arrangement would be provided at an opposite end of roll R. A suitable sprocket-pulley-drive belt arrangement 362, 364, and 366 is likewise provided between axle 355 and a suitable power source 360 located on jeep J to afford a driving movement for roll R to either unroll same or to roll up same. Furthermore, as illustrated in FIG. 6, a further support strut 358 is located at opposite sides of same in pivotal connection with a forming unit or device generally 370 through which the accretion apparatus 210 will pass as the apparatus is played out or taken in by the jeep J. Additionally, a shaker mechanism generally 380 is provided between jeep J and an underside of the forming unit 370 to impart a vibratory motion to same as the material 210 is being reeled in, whereby sand collected on apparatus 210 may be dislodged therefrom.

Utilizing the arrangement as shown in FIG. 6, with the forming unit 370 and the function of same being more particularly described hereinafter, the jeep J may move up and down the beach, traversing an area where it is desirable to realize land accretion. The accretion apparatus is played out and once a suitable accretion has been realized, is removed to reproduce roll R of same for storage or for further playout at a higher ground level. In this fashion, a general accretion of shoreline may be achieved continuously along a beach front to prevent erosion and/or to permit the accreted land to better protect the overall beach front and the dwelling structures or building structures located therealong.

Figure 7:
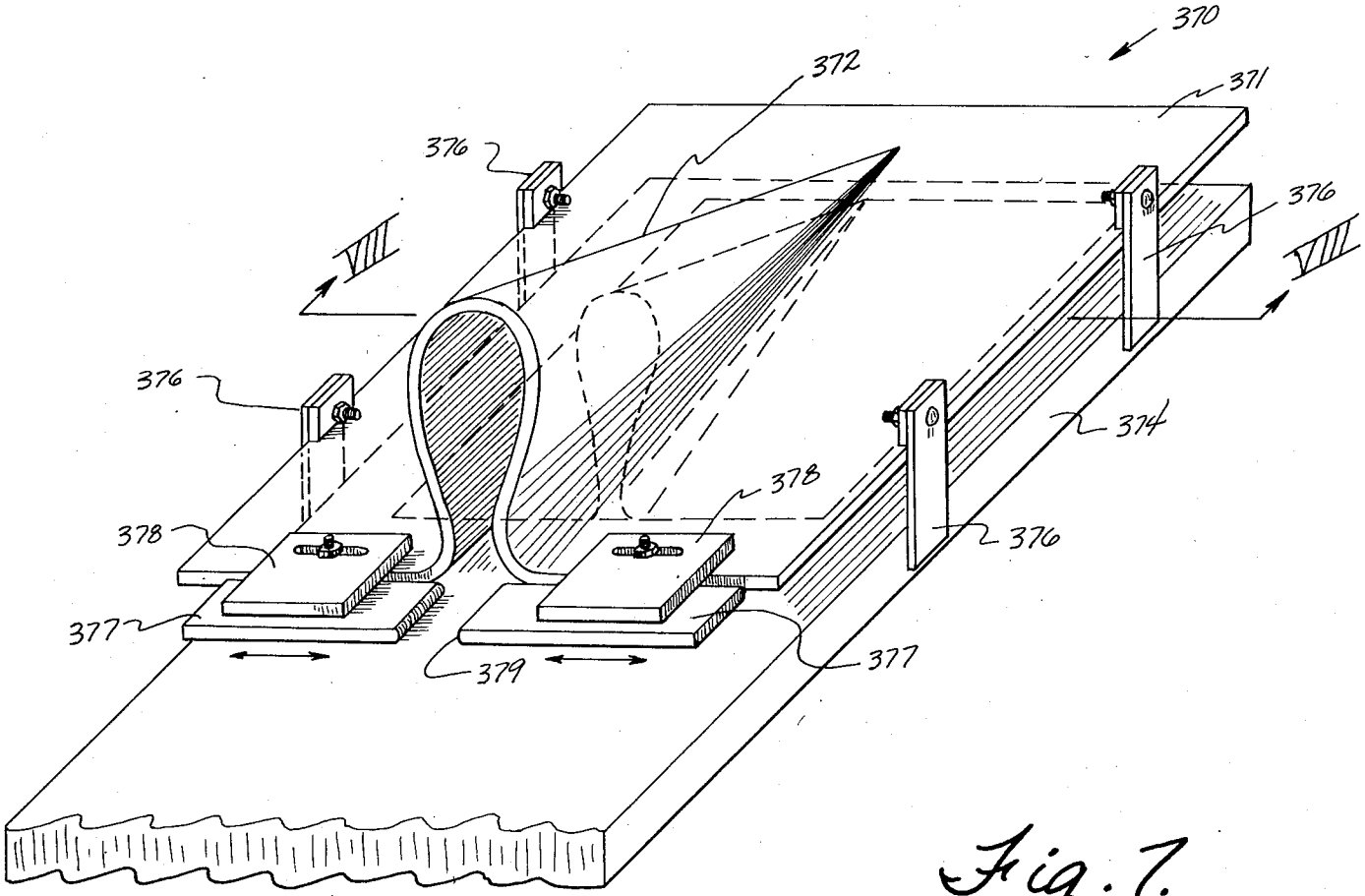
FIG. 7 is an isometric view of the accretion apparatus forming device utilized in conjunction with the embodiment as shown in FIGS. 4 and 5 for forming or unforming the accretion apparatus to and from a flat roll form.
Figure 8:
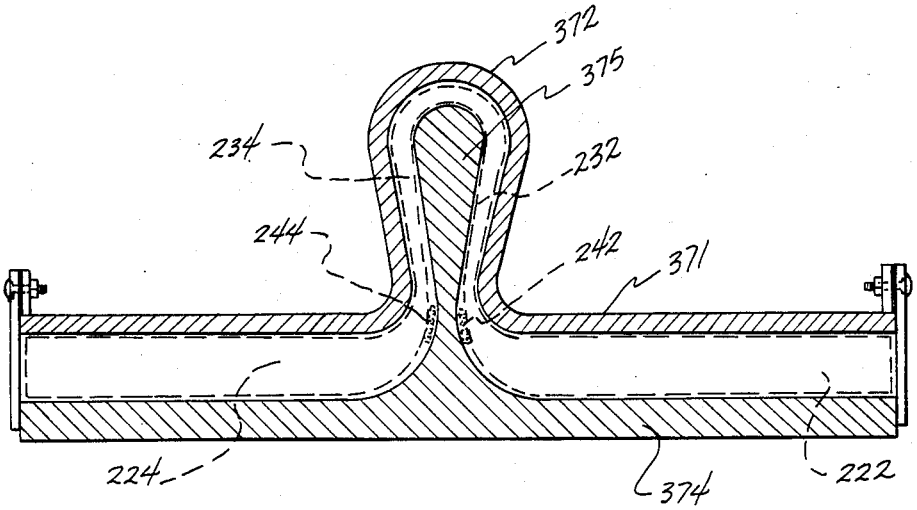
FIG. 8 is a horizontal cross-sectional view of the accretion apparatus forming device as shown in FIG. 7 taken along the line VII—VIII.
Figure 9:
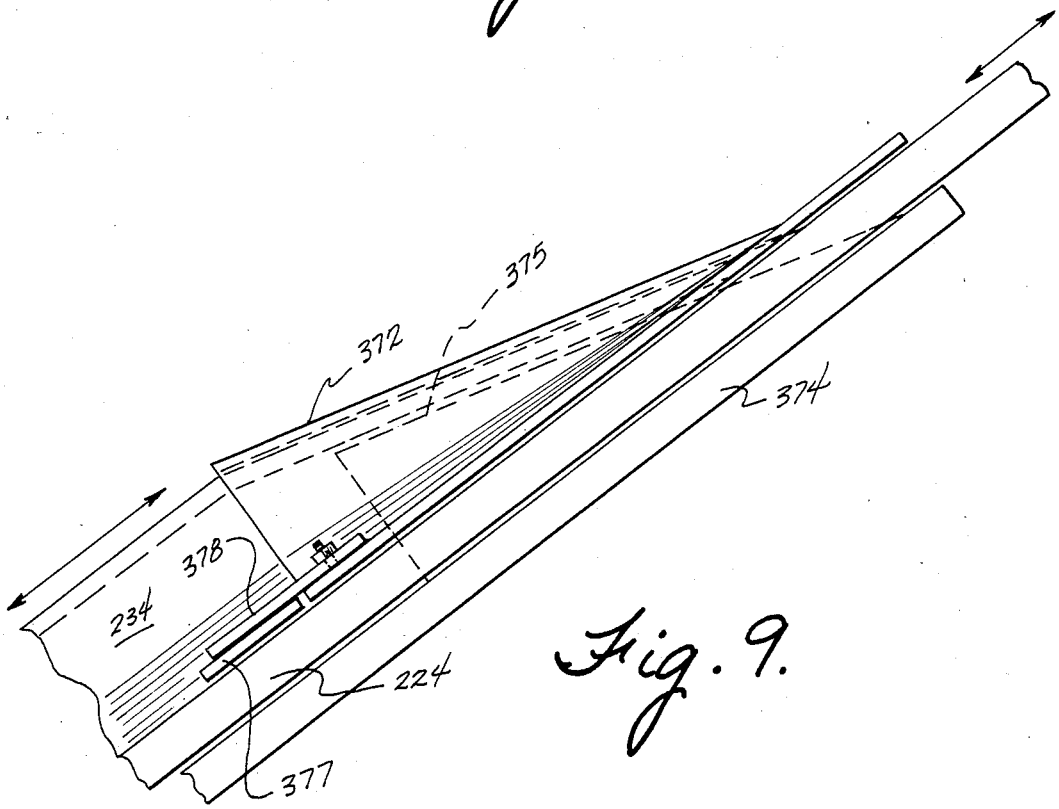
FIG. 9 is a partial side elevational view of the forming apparatus as shown in FIG. 7.

FIGS. 7, 8 and 9 illustrate more detail of the forming unit generally indicated as 370 for converting the flattened material into an erected accretion apparatus or flattening same during retrieval once accretion has occurred. Forming unit generally 370 includes an upper plate 371 that defines an apparatus forming section, preferably in the form of a portion of a frustum 372 along a medial section of same. A bottom plate 374 is secured to upper plate 371 by a plurality of connector elements 376 with the space therebetween being predetermined according to the thickness of the material being handled. Lower plate 374, like upper plate 371, defines an apparatus forming section, preferably a portion of a frustum 375 intermediate the width of same with lower frustum 375 being associated with upper frustum 372 to define a forming space therebetween through which barrier portions 232 and 234 pass.

As the accretion apparatus 210 is passed through forming unit 370, it can thus be seen that upon entering forming unit 370 (from the right hand edge as illustrated in FIG. 9) the barrier portions 232, 234, move upwardly within the forming space defined by frustums 372, 375 such that barrier portion 332 resides on one side of frustum 375 while barrier section 234 resides on an opposite side, and with the base sections 222, 224 being located between upper plate 371 and lower plate 374. With such a forming unit 370 available, and the accretion apparatus 210 in roll form, as the material of the apparatus 210 is unrolled and passed through the forming unit 370, accretion apparatus 210 will automatically assume the configuration as illustrated in FIG. 5 and will be deposited onto the upper surface of the land where buildup is desired. A pair of locking plates 377 are secured to upper forming plate 371 by a linkage 378, located on opposite sides of frustum 372. Locking plates 377 are adjustable with respect to each other such that during erection of apparatus 210, a restricted passageway 379 may be provided therebetween for engagement of barrier portions 232, 234 to force securement means 242, 244 into interengagement. During removal of apparatus 210 from the land surface, locking plates 377 are separated.

Once the buildup has occurred, the jeep or other prime mover may move along the apparatus 210 lifting same from its operative position atop the land where buildup has previously been achieved. In this regard, making specific reference to FIG. 6, it can be seen that a lower portion of bottom plate 374 of the forming unit 370 has a generally sharpened forward end 377 which passes beneath the base sections 222 and 224 and assists in lifting same from the land surface. During such lifting operation, obviously any sand that has accumulated in the space between the base section 224 and the barrier portion 234 will be dislodged therefrom. Since, however, some of the sand may not fall from the apparatus during initial takeup, shaker mechanism generally 380 is provided to impart vibration to forming unit 370 while the accretion apparatus is being reflattened. Vibration of forming unit 370 will thus cause any remaining sand to be dislodged from apparatus 210 and fall therefrom along the forward incline of forming unit 370. With locking plates open, apparatus 210 may be started through forming unit 370 where barrier sections 232, 234 will be separated automatically as the apparatus is retrieved.

For the fabrication of accretion apparatus of the present invention, as mentioned hereinbefore, it is desirable that the barrier section have adequate height and flexibility above the surface where accretion is to occur to flex with the incoming waves and the receding water as described thus permitting sand suspended in the water to settle therefrom to achieve the desired accretion. Rubber elements have proved satisfactory for both the base sections and the barrier section since rubber inherently possesses the necessary flexibility. Also, a rubber base section will follow the general contour of the land surface and is not be easily moved as a unit by the force of the water. As mentioned above, while scrap materials may be utilized to produce an economical accretion apparatus, the apparatus may likewise be extruded or otherwise produced of virgin stock with the appropriate dimensions to achieve the desired result. Where it is desirable to achieve accretion along an extended section of a beach or the like, it is desirable to have extended lengths of accretion apparatus. A continuous extrusion of apparatus would be preferred for such use. Additionally if desirable or necessary for an accretion apparatus of the type depicted in FIGS. 4 and 5, barrier section 230 could include a notched area 335 to facilitate erection of barrier 230 and reduce the upper radius of same in erected form as illustrated in FIG. 5. Similarly, if necessary to achieve the desired flexibility of the barrier 230 as depicted in FIGS. 4 and 5, like notches could be provided along segments of barrier portions 232 and 234 to achieve the particular flexing as necessary to successfully bring about the accretion.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. A movable land accretion apparatus comprising an elongated base support, said base support having a flexible barrier element secured thereto only intermediate the width of same, said barrier element extending upwardly from said base for a predetermined height only and having a predetermined flexibility to deflect upon receipt of adequate force generated by an incoming wave and permit unrestricted passage of water thereabove and return to a generally vertical orientation upon dissipation of said wave force to retain water therebehind for a period adequate for sand to settle from the retained water, and after sufficient water buildup therebehind to deflect in an opposite direction and release water from which sand has settled whereby a sand buildup will occur behind said element, and whereby after said sand buildup, said apparatus may be lifted from beneath said sand buildup and laid atop same to achieve further sand buildup thereat.

2. A land accretion apparatus as defined in claim 1 wherein said base and said barrier are unitary in structure.

3. A land accretion apparatus as defined in claim 1 wherein said barrier is generally centrally located with respect to the width of said base.

4. A land accretion apparatus as defined in claim 1 wherein said barrier is a synthetic polymeric rubber composition.

5. A land accretion apparatus as defined in claim 1 wherein said base comprises a base section secured to opposite sides of said barrier at a lower end of same and extending outwardly therefrom.

6. A land accretion apparatus comprising a base support, said base support having a flexible vertical barrier secured thereto and extending upwardly therefrom, said barrier comprising a first section of continuous width of flexible material which defines two barrier portions, and said base comprising second sections of material at opposite sides of said barrier section, said base material being thicker than said barrier section, whereby said barrier portions may be moved upwardly with respect to said base sections to define said flexible vertical barrier, and securement means located along an underside of said bartier portions for interengagement to secure said barrier section in the erected position, the height and flexibility of said barrier being such that incoming wave force will cause deflection of the barrier for passage of water thereover, after which said barrier will return to a generally vertical orientation and retain water therebehind for a period of time adequate for sand to settle from the water and after adequate water buildup therebehind, said barrier will deflect in the direction of oncoming waves to release water from which sand has settled.

7. A land accretion apparatus as defined in claim 6 wherein said barrier section securement means includes pressure securement means.

8. A land accretion apparatus as defined in claim 6 wherein said apparatus is manufactured from a flexible polymeric material.

9. A method for installing land accretion apparatus comprising the steps of:

(a) proving a supply of accretion apparatus, said apparatus comprising a base section and a barrier section secured to said base section and being adapted to extend transversely outwardly from said base section for generally vertical disposition when installed;

(b) mounting said continuous supply of material on a prime mover; and (c) continouously depositing said material generally parallel to a body of water onto a land surface to be accreted during movement of said prime mover, said material being continuously deposited onto said land surface with said base section in contact with said surface and said barrier section extending outwardly therefrom whereby waves from said body of water will encounter said barrier, and upon application of adequate force will deflect said barrier section in a direction away from said water thus permitting water to pass thereover, after which said barrier section will return to a generally vertical disposition and hold water therebehind to permit said to settle therefrom to build up the land surface.

10. The method as defined in claim 9 wherein said accretion apparatus is in roll form and is unrolled for deposit onto said land surface during movement of said prime mover.

11. The method as defined in claim 9 wherein said accretion apparatus comprises a generally flat element in roll form, said barrier sections being located intermediate the width of said element with a base section secured to opposite sides of same, said barrier section being thinner than said base sections and securement means on an underside of said element, and wherein said element is passed through forming means which forces said portions of said barrier section upwardly with respect to said base sections and brings said securement means into interengagement to secure said barrier portions in an erected position.

12. A land accretion apparatus forming unit comprising a top plate, said top plate defining a raised forming section intermediate the width of same, and a bottom plate associated with said top plate to be spacially separate therefrom by a predetermined amount, said bottom section defining a raised forming section being located within said top plate forming section and complementary thereto, said bottom plate forming section cooperating with said top plate forming section to define a forming space therebetween whereby a generally planar material passing between said plates will be forced upwardly in an intermediate portion of same with outer edges moving inwardly to provide an accretion apparatus including a base section and a barrier section secured thereto and extending upwardly therefrom.

13. A forming unit as defined in claim 12 wherein said forming sections are frustum shaped to gradually force said intermediate portions upwardly and said outer edges inwardly.

14. A forming unit as defined in claim 12 wherein means are located adjacent an exit side of said forming section defining a restricted passageway therebetween, whereby as said apparatus passes therethrough, securement means located thereon are forced into interengagement to secure said apparatus in its erected condition.

15. A forming unit as defined in claim 12 wherein said bottom plate is adapted for securement to a prime mover.

* * * * *